US005621365A

United States Patent [19]

Yamazaki et al.

[11] Patent Number: 5,621,365

[45] Date of Patent: Apr. 15, 1997

[54] LAMINATED DIELECTRIC RESONATOR AND FILTER

[75] Inventors: Kazuhisa Yamazaki; Nobuaki Nakamura; Yasue Nishino; Kazuaki Endo, all of Shizuoka; Yasuo Suzuki, Toyohashi; Mitsuru Kojima, Shizuoka, all of Japan

[73] Assignee: Fuji Electrochemical Co., Ltd., Tokyo, Japan

[21] Appl. No.: 525,769

[22] PCT Filed: Nov. 11, 1994

[86] PCT No.: PCT/JP94/01913

§ 371 Date: Sep. 20, 1995

§ 102(e) Date: Sep. 20, 1995

[87] PCT Pub. No.: WO95/23438

PCT Pub. Date: Aug. 31, 1995

[30] Foreign Application Priority Data

Feb. 18, 1994 [JP] Japan ..... 6-43344
Mar. 29, 1994 [JP] Japan ..... 6-82352

[51] Int. Cl.[6] ..... H01P 1/203; H01P 7/08

[52] U.S. Cl. ..... 333/204; 333/219.1

[58] Field of Search ..... 333/202–205, 333/219, 219.1, 236, 238, 245, 246

[56] References Cited

U.S. PATENT DOCUMENTS 5,014,024 5/1991 Shimizu et al. ..... 333/203
5,344,695 9/1994 Hirai et al. ..... 333/205 X

FOREIGN PATENT DOCUMENTS

0566743A1 10/1993 European Pat. Off. .
59-51606 3/1984 Japan .
2-290303 11/1990 Japan .
5-152815 6/1993 Japan .
5-175702 7/1993 Japan .
5-70006 9/1993 Japan .
6-97705 4/1994 Japan ..... 333/204

*Primary Examiner*—Benny Lee
*Assistant Examiner*—Barbara Summons
*Attorney, Agent, or Firm*—Keck, Mahin & Cate

[57] ABSTRACT

In a laminated dielectric resonator and filter having a folded microstrip line type resonator structure, an internal-to-external grounding conductor distance within which an open-end-side internal conductor pattern is disposed is selected to be shorter than an internal-to-external grounding conductor distance within which a short-circuit-side internal conductor pattern is disposed. In this constitution, since the front end of the resonator structure is loaded with a capacity, the resonance frequency is lowered so that it is possible to provide a resonator having a reduced longitudinal resonator size with respect to the same resonance frequency. In addition, since the resonator has no steps, manufacture and mounting are easy. Accordingly, it is possible to reduce the sizes of the laminated dielectric resonator and filter to a further extent, whereby it is possible to reduce a resonator or filter mounting area in a device.

12 Claims, 9 Drawing Sheets

LAMINATED DIELECTRIC RESONATOR AND FILTER

TECHNICAL FIELD OF THE INVENTION

The present invention relates to a microstrip line type resonator made up of a block-shaped dielectric material in which a plurality of green sheets are laminated and sintered, an in-resonator conductor and an internal grounding conductor provided in the block-shaped dielectric material, and an external grounding conductor formed on an external surface of the dielectric material. More specifically, the present invention relates to a laminated dielectric resonator and a laminated dielectric filter in each of which an in-resonator conductor has a folded structure using a via connection part and an internal-to-external grounding conductor distance on its open-end side is shorter than an internal-to-external grounding conductor distance on its short-circuit side so as to reduce the longitudinal resonator size. Such laminated dielectric resonator or filter is used in, for example, various kinds of microwave wireless units or the like.

BACKGROUND OF THE INVENTION

There are a variety of microwave filters using dielectric material, and one type of filter includes a resonator using a microstrip line. For example, in the case of a ¼ wavelength resonator, a rectilinear microstrip line type in-resonator conductor Is provided in a dielectric block, and one end of the in-resonator conductor is opened and the other end is short-circuited to an external grounding conductor provided on an external surface of the dielectric block. To fabricate a filter, a plurality of in-resonator conductors may be arranged in the dielectric block so as to obtain a coupling strength corresponding to the filter characteristics.

Since such in-resonator conductors are disposed in a plane, this structure has limitations in that the area required to mount the filter is difficult to reduce. As an attempt capable of solving this problem, a folded microstrip line type dielectric resonator and dielectric filter have been proposed (for example, Japanese Patent Laid-Open Nos. 5-152,815/1993 and 5-175,702/1993). The dielectric resonator and filter have a structure in which a U-shaped external grounding conductor is provided on the external peripheral face of a dielectric board which excludes both primary surfaces and each conductor is short-circuited at one end only. In this structure, the in-resonator conductor is folded back in a direction perpendicular to its pattern face.

In such structure, since the ¼ wavelength in-resonator conductor is three-dimensionally folded back so that its entire length is made half or less, it is possible to reduce the area required to mount the dielectric resonator or filter, whereby the size of devices can be reduced. In recent years, further reductions in the sizes of wireless communication units have been demanded, so that a demand for a reduction In the size of the dielectric resonator has become stronger and stronger. However, only the above-described method may be insufficient.

One method for reducing the longitudinal size of the dielectric resonator is to dispose an external grounding conductor in close proximity to the open end of an in-resonator conductor and make use of the phenomenon in which a resonance frequency lowers owing to a load capacity occurring at that place. However, this structure causes an increase in current density at the front end of the in-resonator conductor, thereby causing an increase in loss. As another resonator short-circuit means, a step may be provided on the open-end side of the resonator. This structure, however, is disadvantageous in terms of manufacture and mounting.

SUMMARY OF INVENTION

The present invention has been made in light of the above-described background, and its first object is to provide a laminated dielectric resonator and filter which is reduced in size by means of a folded microstrip line structure as well as which is easy to manufacture and mount and is further reduced in size without impairing performance.

A second object of the present invention is to provide a dielectric filter which is prevented from being peeled or cracked along an internal grounding pattern during degreasing or firing so that higher yield can be achieved and its electrical function or filter characteristics can be prevented from being impaired.

To achieve the first object, the present invention provides a laminated dielectric resonator in which an in-resonator conductor is formed in a block-shaped dielectric material made up of a plurality of sheets which are laminated, the in-resonator conductor being made up of a short-circuit-side and open-end-side internal conductor patterns which are opposed to each other in spaced apart relationship in a pattern-thickness direction, as well as a via-connection part which connects one end of the short-circuit-side internal conductor pattern to one end of the open-end-side internal conductor pattern. In addition, an external grounding conductor is formed on an external surface of the dielectric material in such a manner as to be connected to the other end of the short-circuit-side internal conductor pattern but not to the other end of the open-end-side internal conductor pattern, and an internal grounding conductor is provided between the internal conductor patterns in the dielectric material, the internal grounding conductor being connected to the external grounding conductor but not to the via-connection part, thereby forming a folded microstrip line type resonator structure. The laminated dielectric resonator is characterized in that an internal-to-external grounding conductor distance within which the open-end-side internal conductor pattern is disposed is shorter than an internal-to-external grounding conductor distance within which the short-circuit-side internal conductor pattern is disposed. It is desirable that the specific ratio between both distances be in the range in which the relationship of $0.4<t_1/t_2<1.0$ is satisfied, where $t_1$ indicates the internal-to-external grounding conductor distance within which the open-end-side internal conductor pattern is disposed and $t_2$ indicates the internal-to-external grounding conductor distance within which the short-circuit-side internal conductor pattern is disposed.

The present invention can also be applied to a laminated dielectric :filter In which a plurality of laminated dielectric resonators of the aforesaid type are arranged in parallel and integrated, i.e., a structure in which a plurality of in-resonator conductors are disposed in a dielectric material in spaced apart relationship in the pattern-width direction and an internal grounding conductor and an external grounding conductor are provided. This laminated dielectric filter may be of a comb-line type in which the via connection parts of the plurality of in-resonator conductors are positioned on the same side or of an interdigital type in which the via connection parts are alternately positioned on opposite sides.

If the internal-to-external grounding conductor distance on the open-end side is made smaller than the internal-to-external grounding conductor distance on the short-circuit side, an equivalent circuit, the front end of which is loaded with a capacity, is formed and the resonance frequency lowers. This means that a resonator having the same resonance frequency can be produced by using an in-resonator conductor of reduced length and the smaller the in-resonator conductor is made, the smaller the resonator can be made. According to a circuit simulation, the variation of Q is small in the range of $0.4<t_1/t_2<1.0$, where $t_1$ indicates the internal-to-external grounding conductor distance within which the open-end-side internal conductor pattern is disposed and $t_2$ indicates the internal-to-external grounding conductor distance within which the short-circuit-side internal conductor pattern is disposed. Particularly if $t_1/t_2<0.7$, the length of the in-resonator conductor can be shortened remarkably effectively.

This structure is also a so-called tri-plate structure in which top and bottom grounding conductors are disposed to extend from the short-circuit end to the open end of the resonator, and performance deterioration is small compared with ordinary non-folded resonators. Although a small discontinuity of impedance occurs in a folded part (via connection part), it has experimentally been confirmed that such discontinuity does not greatly impair performance. Even if the value of $t_1/t_2$ is made small, Q does not vary very much. The reason for this is presumed to be that although the open-end side becomes thin and Q deteriorates, the short-circuit side becomes thick and Q improves as far as the entire thickness is uniform.

To achieve the second object, the present invention provides a dielectric filter which comprises a dielectric block body formed by a plurality of dielectric blocks disposed in lamination, an in-resonator conductor formed in a folded state between the plurality of dielectric blocks, a grounding pattern disposed inward of a folded portion of the folded in-resonator conductor in the state of being superposed in part on the folded in-resonator conductor, at a position spaced a predetermined distance apart from the folded portion in a thickness direction. In the dielectric filter, at least one of a through hole and a cutout is formed in a predetermined portion of the grounding pattern.

Preferably, the through hole or the cutout may be formed in a portion of the grounding pattern which excludes a portion superposed on the in-resonator conductor. In addition, the grounding pattern may be made up of a plurality of auxiliary grounding patterns spaced a predetermined distance apart from each other in a thickness direction and disposed to be held at the same potential, each of the auxiliary grounding patterns having a removed portion formed by removing a predetermined portion, the auxiliary grounding patterns being superposed on each other in such a manner that the removed portion of either of the auxiliary grounding patterns is covered by a pattern portion of the other. More preferably, the plurality of auxiliary grounding patterns are electrically connected to each other via a through hole.

Since the through hole, the cutout or the removed portion is provided in the grounding pattern in the above-described manner, dielectric ceramics which constitute dielectric blocks which are respectively positioned above and below the grounding pattern are brought into direct contact with each other via the through hole or the like. Accordingly, the area of connection between the dielectric blocks increases owing to the direct contact, whereby the adhesion strength between both dielectric blocks increases. Accordingly, neither peeling nor cracking occurs in the grounding pattern part during a later sintering process. If a portion in which to form the through hole or the like is provided in an unsuperposed portion which is not to be superposed on the in-resonator conductor, a grounding face is formed over the entire face of a portion to be superposed on the in-resonator conductor. Accordingly, variations in characteristic impedance can be suppressed as much as possible.

If one grounding pattern is formed by superposing a plurality of auxiliary grounding patterns from which predetermined portions are removed a predetermined shape having no holes such as through holes is formed as a whole, so that the effect (the desired electrical characteristics) of providing the grounding pattern is clearly shown. Since the auxiliary grounding patterns are spaced a predetermined distance apart from each other, a dielectric block (ceramics) is necessarily present between the auxiliary grounding patterns. Accordingly, the portion of direct contact between the ceramics positioned on opposite sides of one auxiliary grounding pattern is increased by the area of the removed portions. Accordingly, similarly to the above-described filter, no cracking or the like occurs during a sintering process.

If the auxiliary grounding patterns are connected to each other via the through hole, the electrical integration (the same potential) of the auxiliary grounding patterns is promoted. If the area of the grounding pattern is large and the distance between the auxiliary grounding patterns is long, it is possible to effectively hold the auxiliary grounding patterns at the same potential owing to the through hole, particularly in a high-frequency band.

BRIEF DESCRIPTION OF DRAWINGS

FIGS. 1A and 1B show a first embodiment of a laminated dielectric resonator for achieving the aforesaid first object of the present invention, wherein FIG. 1A is a perspective view showing the external appearance of the first embodiment and FIG. 1B is a longitudinal sectional view showing the internal structure of the first embodiment;

FIGS. 4A, 4B and 4C show the result of simulation of the size and characteristics of the laminated dielectric resonator according to the present invention, wherein FIG. 4A is a cross-sectional view showing the structure of the resonator and FIGS. 4B and 4C are graphs showing a strip line length and variations of $Q_0$;

FIGS. 5A and 5B show one embodiment of a laminated dielectric resonator according to the present invention, wherein FIG. 5A is a perspective view showing the external appearance of the embodiment and FIG. 5B is an explanatory view representing a horizontal section taken at a position where internal grounding conductors are located;

FIGS. 6A and 6B showing another embodiment of the laminated dielectric filter according to the present invention, wherein FIG. 6A is a perspective view showing the external appearance of the embodiment and FIG. 6B is an explanatory view representing a horizontal section taken at a position where internal grounding conductors are located;

BEST MODE FOR CARRYING OUT THE INVENTION

Figure 1A:
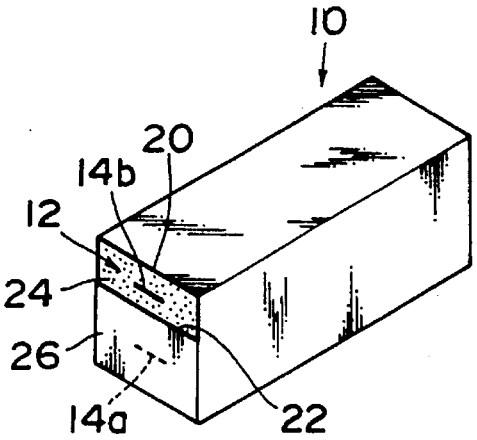

Preferred embodiments of a dielectric filter according to the present invention and a method of manufacturing the same will be described below with reference to the accompanying drawings.

A laminated dielectric resonator 10 is a folded strip line type of resonator. A block-shaped dielectric material 12 is made up of a multiplicity of laminated sheets, and an in-resonator conductor 18 is formed inside the dielectric material 12. The in-resonator conductor 18 is made up of an short-circuit-side internal conductor pattern 14*a* and an open-end-side internal conductor pattern 14*b*, which are opposed to each other in spaced apart relationship in the pattern-thickness direction, as well as a via connection apart 16 which connects one end of the internal conductor pattern 14*a* to one end of the internal conductor pattern 14*b*. An external grounding conductor 20, which is connected to the other end of the short-circuit side internal conductor pattern 14*a* but not to the other end of the open-end-side internal conductor pattern 14*b*, is formed on the external surface of the dielectric material 12, while an internal grounding conductor 22, which is connected to the external grounding conductor 20 but not to the via connection part 16, is provided between the internal conductor patterns 14*a* and 14*b* inside the dielectric material 12. The present invention is characterized in that an internal-to-external grounding conductor distance t1 within which the open-end-side internal conductor pattern 14*b* is disposed is selected to be shorter than an internal-to-external grounding conductor distance $t_2$ within which the short-circuit-side internal conductor pattern 14*a* is disposed.

In this embodiment, the other end of the open-end-side internal conductor pattern 14*b* is exposed on the surface of the dielectric material 12, and an open end face 24 which is not covered with the external grounding conductor 20 is formed around the exposed other end. The entire external surface which excludes the open end face 24 is covered with the external grounding conductor 20. That is to say, the portion of one end face of the block-shaped dielectric material 12 which is above the internal grounding conductor 22 constitutes the open end face 24, while the portion of the one end face which is below the internal grounding conductor 22 constitutes a short-circuit end face 26.

It is preferable that the relationship between the internal-to-external grounding conductor distance $t_1$ within which the open-end-side internal conductor pattern 14*b* is disposed and the internal-to-external grounding conductor distance $t_2$ within which the short-circuit-side internal conductor pattern 14*a* is disposed be selected to satisfy $0.4<t_1/t_2<1.0$, more preferably, $0.4<t_1/t_2<0.7$.

Figure 2:
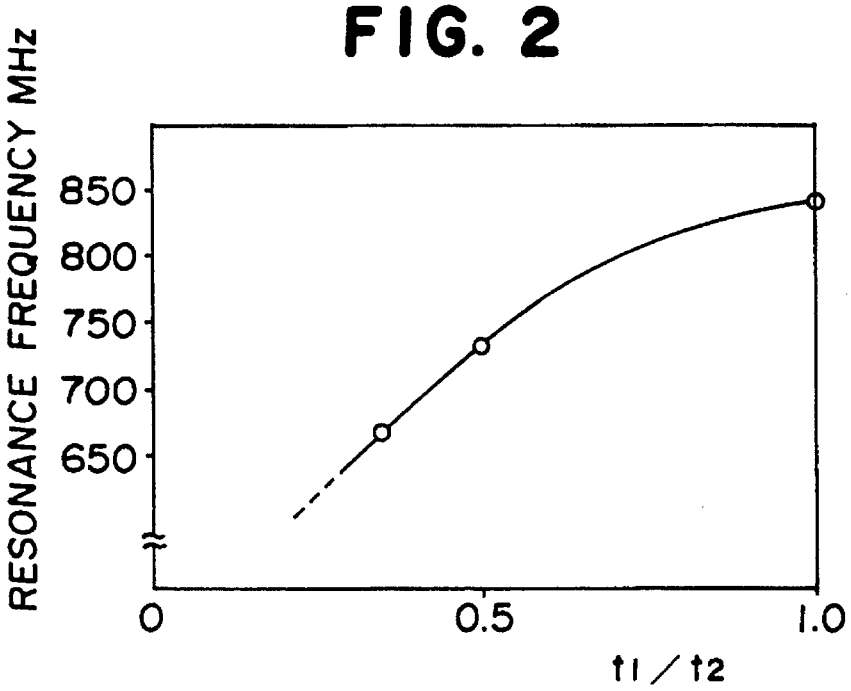
FIG. 2 is a graph showing the relationship between $t_1/t_2$ and a resonance frequency $f_0$ of the laminated dielectric resonator shown in FIGS. 1A and 1B.

If the internal-to-external grounding conductor distance $t_1$ on the open-end side is made smaller than the internal-to-external grounding conductor distance $t_2$ on the short-circuit side, an equivalent circuit, the front end of which is loaded with a capacity, is formed and a resonance frequency $f_0$ lowers as shown in FIG. 2. This means that a resonator having the same resonance frequency can be produced by using an in-resonator conductor of reduced length and the smaller the In-resonator conductor is made, the smaller the resonator can be made. In addition, according to a circuit simulation, the variation of Q is small in the range of $0.4<t_1t_2<1.0$. This structure is also a so-called tri-plate structure in which top and bottom grounding conductors are disposed to extend from the short-circuit end to the open end of the resonator, and performance deterioration is small compared with ordinary non-folded resonators. Although a small discontinuity of impedance occurs in a folded part (via connection part), it has experimentally been confirmed that such discontinuity does not greatly impair performance. Even if the value of $t_1/t_2$ is made small, Q does not vary very much. The reason for this is presumed to be that although the open-end side becomes thin and Q deteriorates, the short-circuit side becomes thick and Q improves as far as the entire thickness is uniform.

Figure 3:
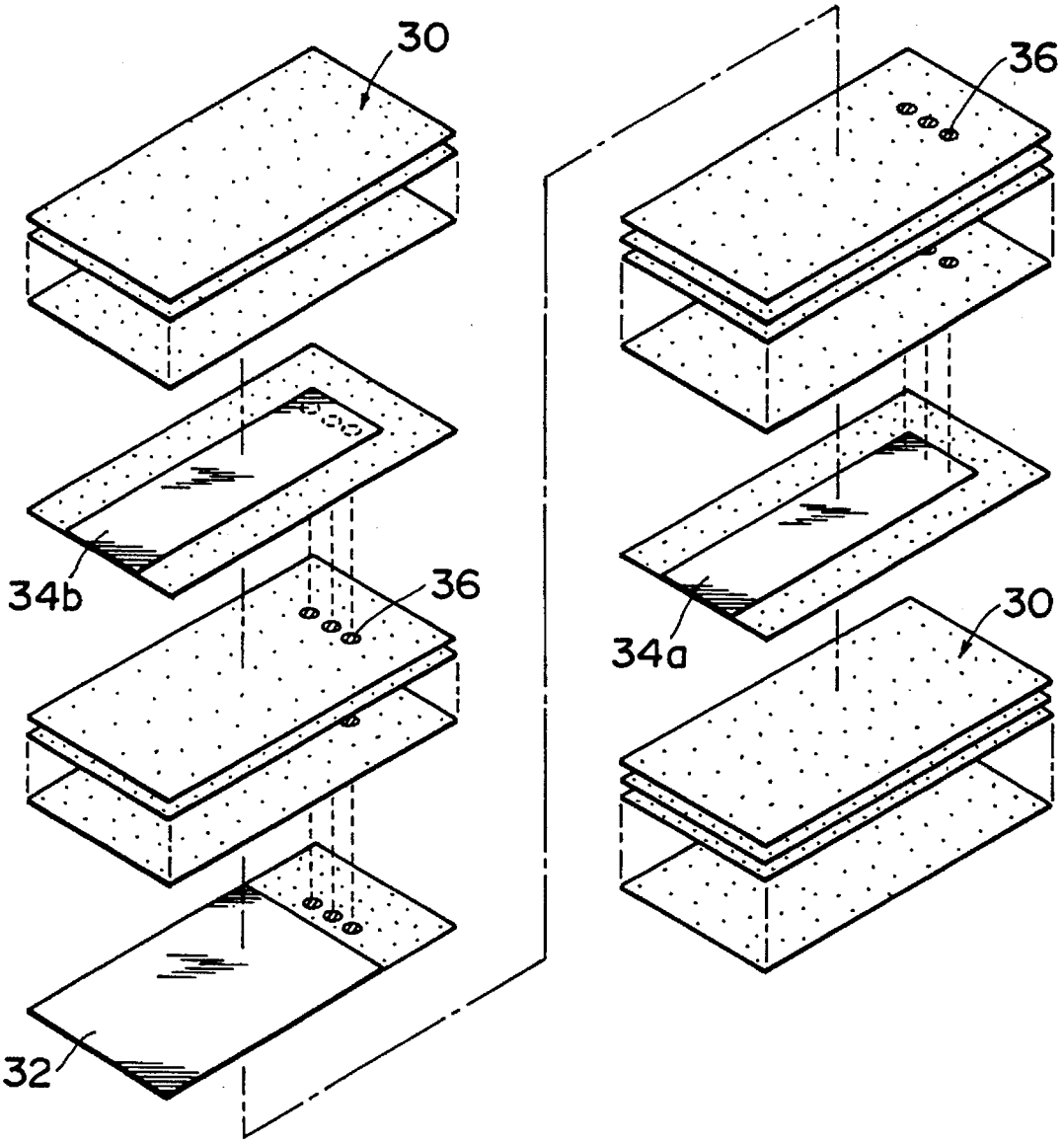
FIG. 3 is an explanatory view showing one example of a process for manufacturing the aforesaid laminated dielectric resonator.

The laminated dielectric resonator according to the present invention can be manufactured through, for example, the process shown in FIG. 3. Although the process of producing a single laminated is dielectric resonator referred to herein for the sake of simplification of description and illustration, practical manufacture is carried out in such a way as to produce a multiplicity of laminated dielectric resonators at a time. The laminated dielectric resonator is manufactured by laminating about 30 to about 170 green sheets 30 made of high-permittivity material, integrating the laminated green sheets by pressure, and sintering the integrated product.

Each of the green sheets 30 is an unfired product prepared by kneading microwave high-permittivity material powder, such as barium titanate, and an organic binder or the like and forming the kneaded product into a sheet-like shape (for example, about 30–170 μm in thickness) by a doctor-blade process, a rolling process or the like. An internal grounding conductor pattern 32, which is of shorter length than and of the same width as the green sheet 30, is formed on one (or two) green sheet which is selected from the multiplicity of green sheets 30 as a green sheet to be located slightly above the middle position of the laminated dielectric resonator. An open-side internal conductor pattern 34*b*, which is of long rectangular shape, is formed on one (or two) green sheet which is selected from the multiplicity of green sheets 30 as a green sheet to be located at the middle position between the internal grounding conductor pattern 32 and the top green sheet. Further, a short-circuit-side internal conductor pattern 34*a*, which is of long rectangular shape, is formed on one (or two) green sheet which is selected from the multiplicity of green sheets 30 as a green sheet to be located at the middle position between the Internal grounding conductor pattern 32 and the bottom green sheet. These conductor patterns 32, 34*b* and 34*a* are printed on the respective green sheets 30, as by screen printing with conductive paste (silver paste or the like). Each green sheet to be located between both internal conductor patterns 34*a* and 34*b* has one to several small via holes which are formed, as by punching, at identical positions close to the front end of the internal conductor pattern 34*a* or 34*b*. The via holes are filled with a conductive material (for example, silver paste) 36. If the thickness of each of the green sheets 30 is on the order of 50–60 μm, the diameter of each of the via holes is made approximately 0.1–0.2 mm. If the via-hole diameter is excessively large, the filling material may come away, whereas if it is excessively small, no complete filling can be carried out.

The multiplicity of green sheets 30 are positionally adjusted and laminated, then integrated by pressure, and then fired. Thus, in the dielectric material in which the multiplicity of green sheets are laminated and integrated, the via connection part Is formed by the conductive material provided in the via holes and the open-end-side internal conductor pattern is electrically connected to the short-circuit-side internal conductor pattern. Since the via holes are located outside the internal grounding conductor (refer to reference numeral 32), no electrical conduction occurs between the via connection part and the internal grounding conductor. Subsequently, as shown in FIG. 1A, the required external grounding conductor 20 is formed on the external surface of the sintered product. In this case, conductive paste may be applied and baked. The internal grounding conductor is connected to the external grounding conductor 20 on its three sides, and the short-circuit-side internal conductor pattern is also connected to the external grounding conductor 20 at the partially exposed end of the dielectric material. Thus, the folded microstrip line type resonator is obtained. Adjustment of the ratio of the internal-to-external grounding conductor distance $t_1$ within which the open-end-side internal conductor pattern is disposed to the internal-to-external grounding conductor distance $t_2$ within which the short-circuit-side internal conductor pattern is disposed can readily be performed by selecting the number of the green sheets 30 to be laminated.

Figure 1B:
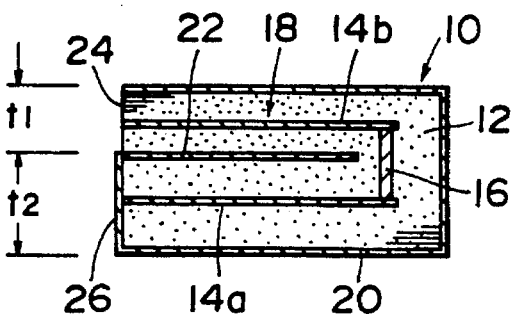
Figure 4A:
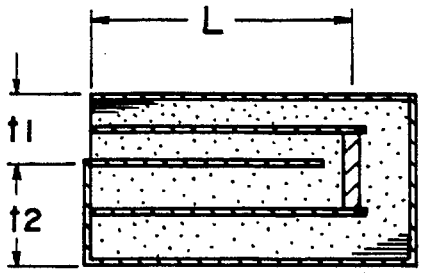
Figure 4B:
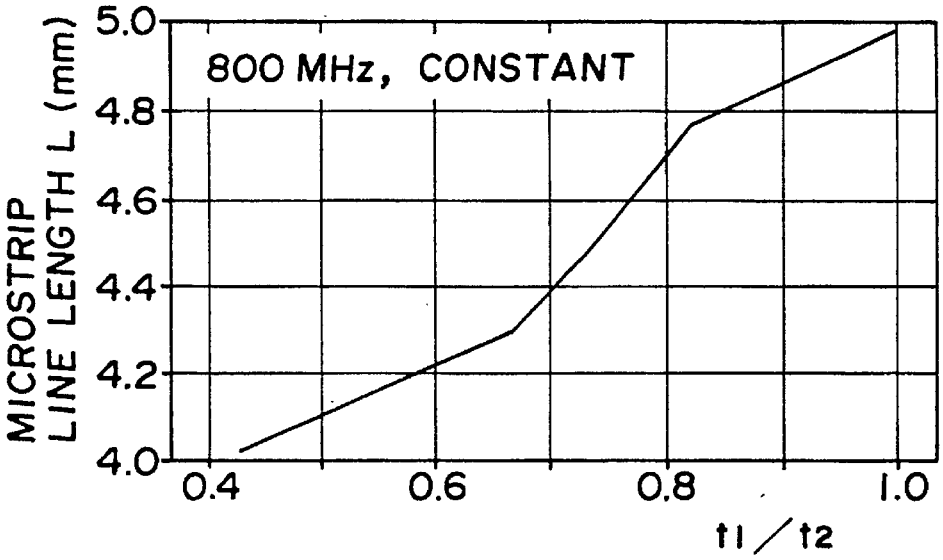
Figure 4C:
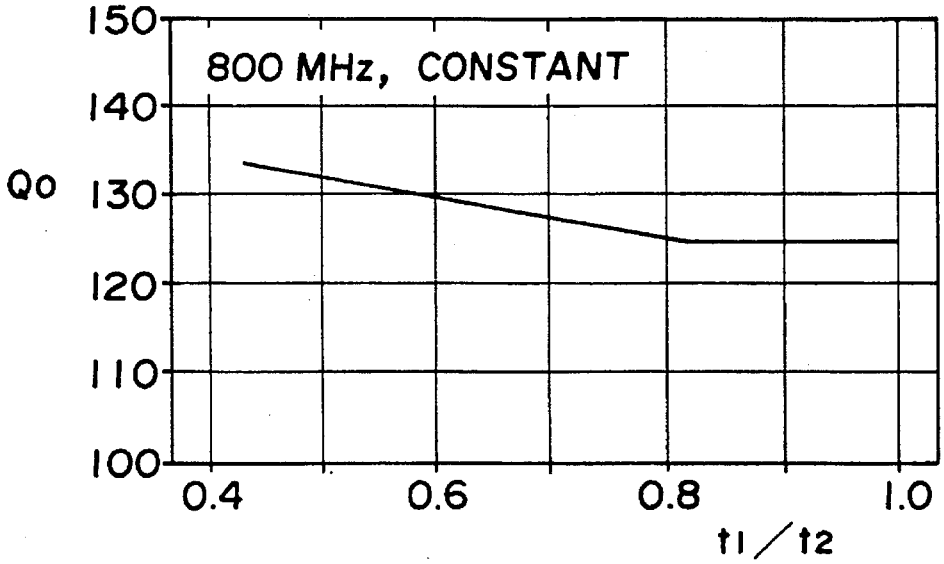

FIGS. 4A, 4B and 4C show one example of the simulation result of resonator characteristics. The structure of the laminated dielectric resonator is identical to that shown in FIG. 1B. In obtaining the calculation result, the ratio R ($=t_1/t_2$) of the open-end-side internal-to-external grounding conductor distance $t_1$ to the short-circuit-side internal-to-external grounding conductor distance $t_2$ was made to vary with the height of the entire resonator kept nearly constant (approximately 3 mm), and the microstrip-line length L was adjusted to keep the resonance frequency $f_0$ nearly constant (about 800 MHz). It is assumed here that the dielectric constant $\epsilon_r$ of the dielectric material is 65, the microstrip-line width is 1 mm, and the via-hole diameter is 0.15 mm. Table 1 shows the resonator sizes and the resonator characteristics.

TABLE 1

| RESONATOR SIZES | | | | RESONATOR CHARACTERISTICS | | | |
|---|---|---|---|---|---|---|---|
| $t_1$ | $t_2$ | R | L | $f_0$(MHz) | ATT(dB) | ΔBt(MHz) | $Q_0$ |
| 1.50 | 1.50 | 1.00 | 4.985 | 800.0 | 6.05 | 12.9 | 124.5 |
| 1.35 | 1.65 | 0.82 | 4.765 | 800.0 | 6.05 | 12.9 | 124.5 |
| 1.35 | 1.80 | 0.75 | 4.535 | 800.0 | 6.13 | 12.9 | 125.6 |
| 1.20 | 1.80 | 0.67 | 4.290 | 800.0 | 6.13 | 12.7 | 127.6 |
| 0.90 | 2.10 | 0.43 | 4.020 | 800.0 | 5.96 | 11.9 | 138.5 |

As shown in FIG. 4B, if the ratio R ($=t_1/t_2$) of the open-end-side internal-to-external grounding conductor distance $t_1$ to the short-circuit-side internal-to-external grounding conductor distance $t_2$ is made smaller, the microstrip-line length L becomes shorter. Particularly if R ($=t_1/t_2$) is smaller than or equal to 0.7, the microstrip-line length L can be remarkably shortened. In contrast, no substantial variation occurs in any of the amount of attenuation ATT, the bandwidth ΔBt, and $Q_0$. The reasons why, in the present invention, it is preferable to make the aforesaid ratio R ($=t_1/t_2$) greater than or equal to 0.4 are as follows: if the open-end side is made excessively thin, the resonator becomes difficult to manufacture (for example, the external grounding conductor is not easily coated); the operation of cutting the open-end face for the purpose of frequency adjustment becomes difficult (not only is positioning difficult but also the cutting operation is difficult); and the influence of capacity becomes excessively large, so that variations easily occur in the resonance frequency. For these reasons, the ratio R ($=t_1/t_2$) is preferably $0.4<R$ ($=t_1/t_2$)$<1.0$, more preferably, $0.4<R$ ($=t_1/t_2$)$<0.7$.

Figure 5A:
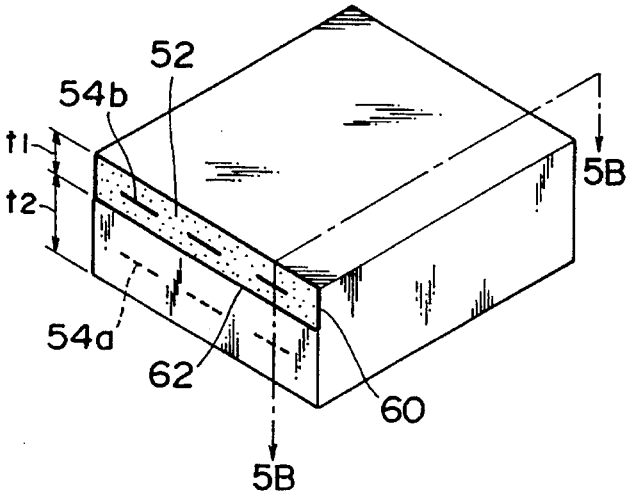
Figure 5B:
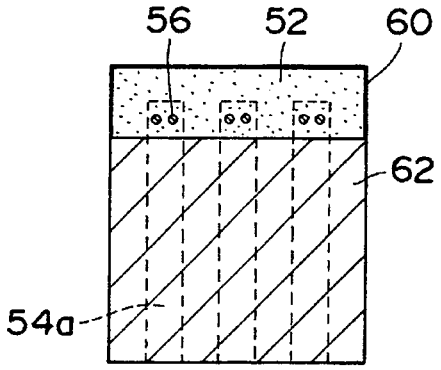

The present invention can also be applied to a laminated dielectric filter. Another embodiment is shown in FIGS. 5A and 5B. The shown embodiment is a three-stage filter which contains three in-resonator conductors. The X—X cross section of FIG. 5A is identical to FIG. 1B.

The shown laminated dielectric filter is a folded microstrip line type filter. A block-shaped dielectric material 52 is made up of a multiplicity of laminated sheets, and three in-resonator conductors are formed inside the dielectric material 52 in such a manner as to be spaced apart from one another in the pattern-thickness direction. Each of the three in-resonator conductors is made up of a short-circuit-side internal conductor pattern 54*a* and an open-end-side internal conductor pattern 54*b*, which are opposed to each other in spaced apart relationship in the pattern-thickness direction, as well as a via connection part 56 which connects one end of the internal conductor pattern 54*a* to one end of the internal conductor pattern 54*b*. An external grounding conductor 60, which is connected to the other end of the short-circuit side internal conductor pattern 54*a* but not to the other end of the open-end-side internal conductor pattern 54*b*, is formed on the external surface of the dielectric material 52, while an internal grounding conductor 62, which is connected to the external grounding conductor 60 but not to the via connection part 56, is provided between the internal conductor patterns 54*a* and 54*b* inside the dielectric material 52. The internal-to-external grounding conductor distance $t_1$ within which the open-end-side internal conductor pattern 54*b* is disposed is selected to be shorter than the internal-to-external grounding conductor distance $t_2$ within which the short-circuit-side internal conductor pattern 54*a* is disposed. In this embodiment, the three in-resonator conductors are arranged in such a manner that their via connection parts 56 are positioned on the same side, thereby constituting a comb-line filter. The internal grounding conductor 62 is connected to the external grounding conductor 60 on its three sides.

According to the feature of laminating a multiplicity of ceramics green sheets, it is possible to provide a constitution capable of adjusting the degree of coupling between each resonator by preparing green sheets each having a part filled with a different kind of material (for example, low-permittivity material), the part being similar in structure to the via connection part and being formed at an intermediate position between adjacent in-resonator conductors.

Figure 6A:
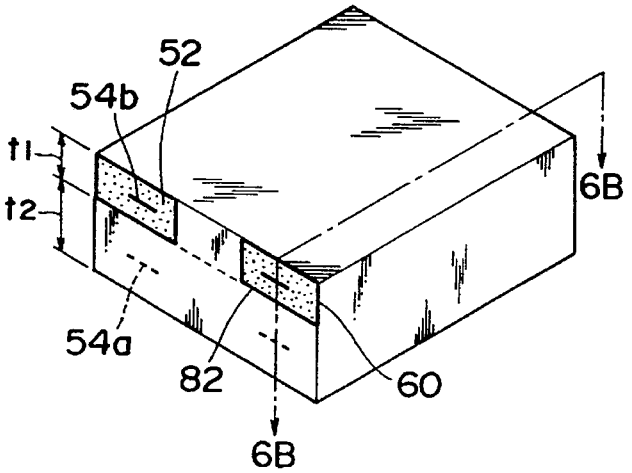
Figure 6B:
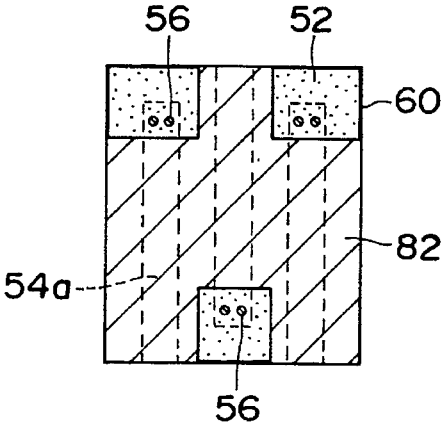

FIGS. 6A and 6B show another embodiment. The laminated dielectric filter shown in FIGS. 6A and 6B is a three-stage interdigital filter. In the laminated dielectric filter shown in these figures, three in-resonator conductors are formed inside the block-shaped dielectric material 52 made up of a multiplicity of laminated sheets. Each of the three in-resonator conductors is made up of the short-circuit-side and open-end-side internal conductor patterns 54*a* and 54*b* which are opposed to each other in spaced apart relationship in the pattern-thickness direction, as well as the via connection part 56 which connects one end of the internal conductor pattern 54*a* to one end of the internal conductor pattern 54*b*. The three in-resonator conductors are disposed in spaced apart relationship in the pattern-width direction in such a manner that their via connection parts 56 are alternately located on opposite sides. The external grounding conductor 60, which is connected to the other end of the short-circuit side internal conductor pattern 54*a* but not to the other end of the open-end-side internal conductor pattern 54*b*, is formed on the external surface of the dielectric material 52, while an internal grounding conductor 82, which is connected to the external grounding conductor 60 but not to the via connection part 56, is provided between the internal conductor patterns 54*a* and 54*b* inside the dielectric material 52. Specifically, the internal grounding conductor 82 has the shape of avoiding the three via connection parts 56 and is connected to part of the external grounding conductor 60 on its four sides, thereby constituting the three-stage interdigital filter. In this embodiment as well, the open-end-side internal-to-external grounding conductor distance $t_1$ is selected to be shorter than the short-circuit-side internal-to-external grounding conductor distance $t_2$.

Although the laminated dielectric resonator referred to above as the above-described embodiment is of the three-stage type, the present invention can, of course, be applied to two-stage filters or filters having four or more stages.

As described above, either of the aforesaid embodiments constitutes a folded microstrip line type resonator structure, and the intern&l-to-external grounding conductor distance within which the open-end-side internal conductor pattern is disposed is selected to be shorter than the internal-to-external grounding conductor distance within which the short-circuit-side internal conductor pattern is disposed. Accordingly, since the front end of the resonator structure is loaded with a capacity, the resonance frequency is lowered so that it is possible to provide a resonator having a reduced longitudinal resonator size with respect to the same resonance frequency. In addition, since the resonator has no steps, manufacture and mounting are easy and no performance is impaired. Accordingly, it is possible to reduce the sizes of the laminated dielectric resonator and filter to a further extent, whereby it is possible to reduce a resonator or filter mounting area in a device.

In each of the embodiments shown in FIGS. 1A and 4A, the open end of the internal conductor reaches the open end face (the open-end-side internal conductor pattern indicated by reference numeral 14*b* in FIG. 1A). However, the present invention is not limited to this constitution, and can also be applied to a constitution in which the open end of the internal conductor pattern does not reach a side face. According to this constitution, a conductor on the side face can be collectively formed by solid printing, whereby a cost reduction can be realized.

A constitution for achieving the aforesaid second object of the present invention will be described below with reference to FIGS. 7 to 10.

As shown in these figures, a dielectric block body 110 having the shape of a rectangular parallelepiped is constituted by laminating first to fourth dielectric blocks 110*a* to 110*d* which are shown as separate blocks for convenience's sake. Although not shown, each of the dielectric blocks 110*a* to 110*d* is made up of a predetermined number of thin dielectric (ceramics) laminated sheets, such as green sheets, or a single plate (ceramics) of predetermined thickness manufactured by various processes.

Figure 9:
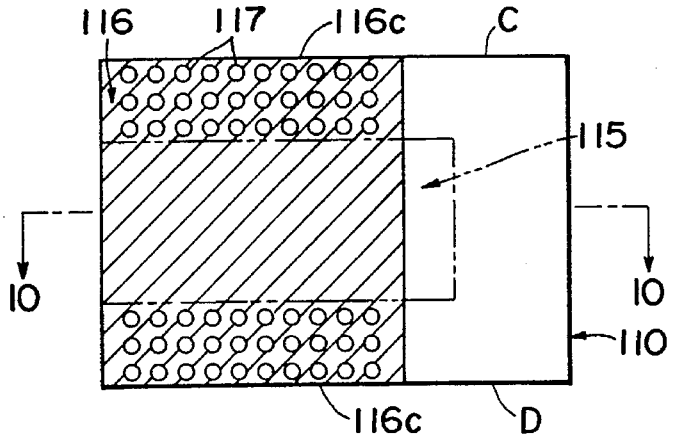
FIG. 9 is a horizontal sectional view of the dielectric filter shown in FIG. 7.
Figure 10:
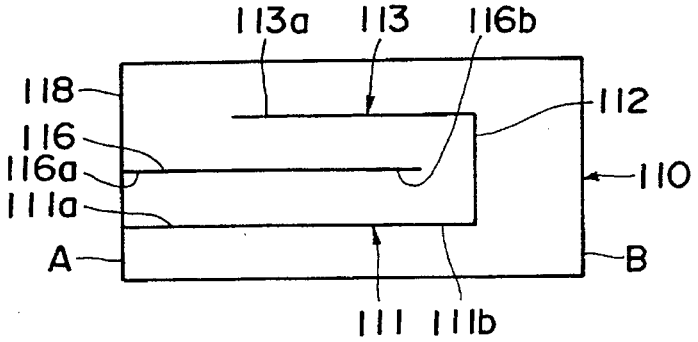
FIG. 10 is a cross-sectional view taken along line a—a of FIG. 9.

A strip-shaped first pattern 111 which constitutes part of an in-resonator conductor pattern 115, indicated in FIG. 9, is formed at a predetermined position on the top face of the fourth dielectric block 110*d*. As shown in FIG. 10, one end 111*a* of the first pattern 111 is positioned on one side A of the dielectric block body 110 (which corresponds to the open end face 24 and the short-circuit end face 26 of the embodiment shown in FIG. 1B), while the other end 111*b* is positioned closer to the opposite side B than the side A. A predetermined distance is formed between the other end 111*b* and the opposite side B.

A second pattern 112 is formed to vertically extend through third and second dielectric blocks 110*c* and 110*b* in such a manner that one side of the second pattern 112 has contact with the other end 111*b* of the first pattern 111. A third pattern 113, which has contact with the opposite side of the second pattern 112 and is parallel to the first pattern 111, is formed on the top face of the second dielectric block 110*b*. A front end 113*a* of the third pattern 113 (the side on which the third pattern 113 has no contact with the second pattern 112) is spaced a predetermined distance apart from the side A of the dielectric block body 110. Specifically, the third pattern 113 and the first pattern 111 have a strip shape with the same width, and the third pattern 113 is shorter than the first pattern 111 by a predetermined length. The first to third patterns 111 to 113 constitute a folded in-resonator conductor pattern 114, indicated in FIG. 7, and the total length of the patterns 111 to 113 is selected to be approximately a ¼ wavelength.

In this embodiment, almost all surfaces of the dielectric block body 110 are covered with a conductor which forms a grounding layer 118. The one end 111*a* of the first pattern 111 which constitutes the in-resonator conductor pattern 114 is connected to the grounding layer 118 for grounding purposes. Although not shown, an input/output pattern of predetermined shape is formed on the top of a predetermined dielectric block as required. .The input/output pattern may be formed in various shapes such as an L-like shape in plan view. Although the shown embodiment is provided with a single in-resonator conductor 114, several in-resonator conductors may also be provided.

According to the above-described constitution, since the in-resonator conductor pattern 114 is folded, the longitudinal size of the in-resonator conductor pattern 114 can be made shorter than the length of a ¼ wavelength, whereby it is possible to reduce the longitudinal size of the dielectric filter.

A grounding pattern 116 having an approximately rectangular shape in plan view is formed at a predetermined position on the top of the third dielectric block 110*c*, and the grounding pattern 116 is inserted into the inside of the folded in-resonator conductor pattern 114. The grounding pattern 116 is disposed between the first and third patterns 111 and 113 which constitute the in-resonator conductor pattern 114, at a location where the three patterns 111, 113 and 116 can be vertically coincident with (superposed upon) one another. One end 116*a* of the grounding pattern 116 is connected to the grounding layer 118 provided on the side A of the dielectric block body 110, while the other end 116*b* is spaced a predetermined distance apart from the second pattern 112 which constitutes the in-resonator conductor pattern 114. As FIG. 9 shows, the remaining two sides 116*c* of the grounding pattern 116 are connected to the grounding layer 118 provided on the remaining two sides C and D of the dielectric block body 110.

According to the above-described constitution, since it is possible to suppress adverse influences due to distributed capacity occurring between the first pattern 111 and the third pattern 113, it is possible to reduce the distance between both patterns 111 and 113. Accordingly, the thickness of the resonator structure can be reduced to a further extent.

In the above-described constitution, the first pattern 111 of the in-resonator conductor pattern 114 is interposed between the grounding pattern 116 and the grounding layer 118 positioned on the bottom side of the dielectric block body 110, while the third pattern 113 is interposed between the grounding pattern 116 and the grounding layer 118 positioned on the top side of the dielectric block body 110. Accordingly, although the thicknesses of the dielectric blocks 110*a* to 110*d* are made equal, as shown, for the purpose of improving the Q value of the dielectric filter, they need not necessarily be equal to one another. In addition, for example by properly changing the permittivity of each of the dielectric blocks 110*a* to 110*d*, it is possible to change their individual thicknesses without causing deterioration of the characteristics.

In the shown embodiment of the present invention, a plurality of through holes 117 are formed in the grounding pattern 116 at predetermined positions thereof. Dielectric ceramics which constitute the second dielectric block 110*b* and the third dielectric block 110*c* which are respectively positioned above and below the grounding pattern 116 are brought into direct contact with each other via the through holes 117. Accordingly, the area of direct contact of or direct connection between the second and third dielectric blocks 110*b* and 110*c* is increased owing to the through holes 117, whereby the adhesion strength between the second and third dielectric blocks 110*b* and 110*c* is increased. Accordingly, neither peeling nor cracking occurs in the grounding pattern part during a later sintering process.

In addition, in this embodiment, the through holes 117 are formed in a portion which is not superposed on the first pattern 111 nor the third pattern 113 (refer to FIGS. 9 and 10). Thus, a grounding face is formed over the projection portion between the first and third patterns 111 and 113 (i.e., the portion in which the first and third patterns 111 and 113 are superposed on each other). Accordingly, variations in characteristic impedance can be suppressed as much as possible, whereby the effect of providing the grounding pattern 116 can be fully utilized.

However, it is desirable that the total area of the through holes 117 be made less than or equal to 304. If the total area of the through holes 117 is excessively large, large variations in characteristic impedance easily take place. If such a filter is incorporated into a device, the electrical function of the device will be impaired.

Figure 8:
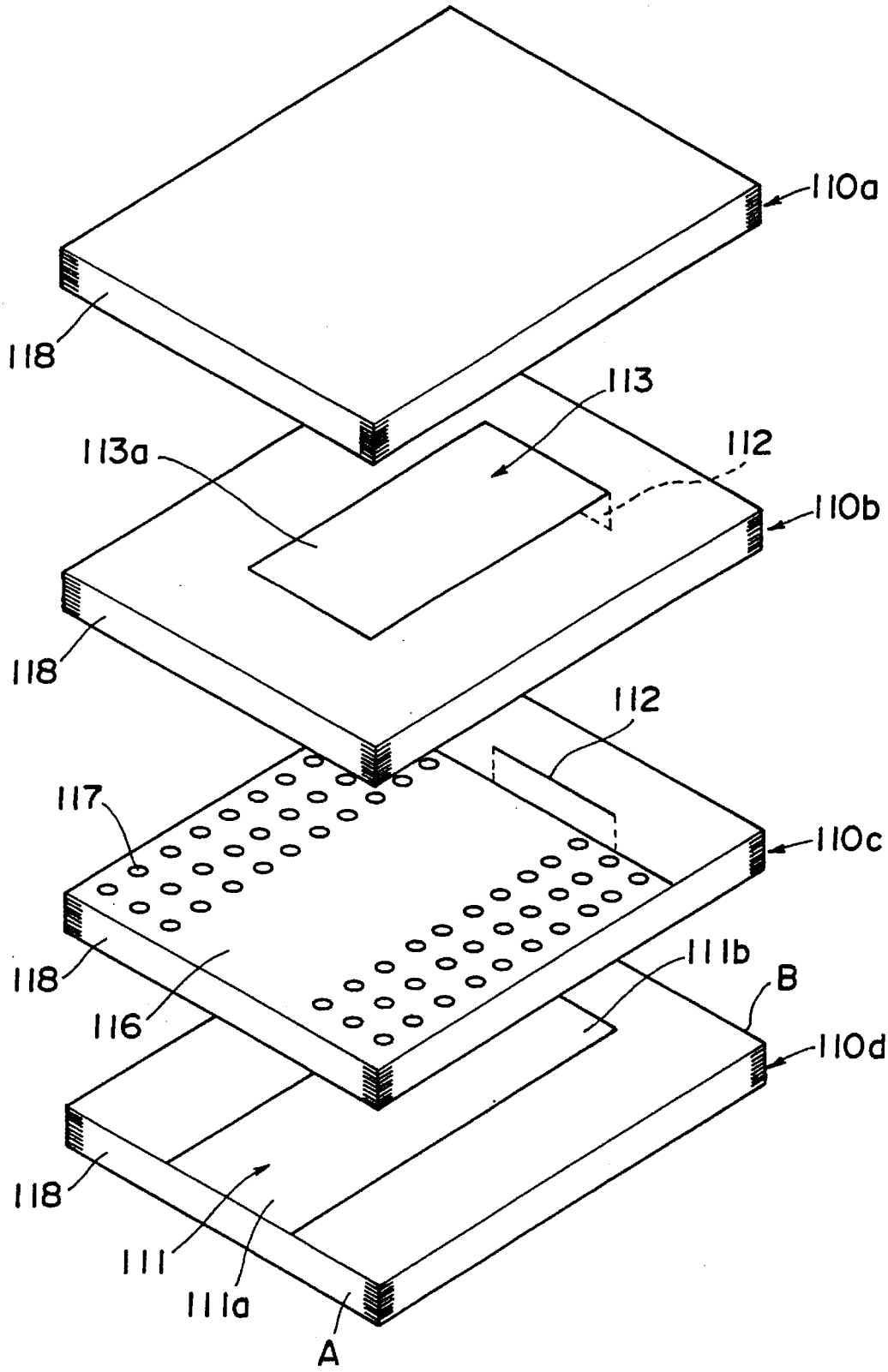
FIG. 8 is an exploded perspective view of the dielectric filter shown in FIG. 7.

One example of a method of manufacturing the dielectric filter having the above-described constitution will be described. For example, as shown in FIG. 8, conductive paste (silver paste) is applied to a predetermined portion of the top face of each of the dielectric blocks 110*b*, 110*c* and 110*d*, as by screen printing, and the first and third patterns 111 and 113 may be formed by carrying out low-temperature sintering, etching or the like. The second pattern 112 may be formed by charging the conductive paste (silver paste) into the through hole formed at a predetermined position in the second dielectric block 110*b* or by inserting a metal plate into such through hole.

If each of the patterns 111, 112 and 113 is to be formed by using the conductive paste, the conductive paste is screen-printed at a predetermined position on dielectric ceramics green sheets which can be sintered at a low temperature, and the green sheets, after they are dried, are superposed and pressed. The pressed green sheets are sintered at the same time, whereby the dielectric filter can be manufactured by one sintering step.

Figure 11A:
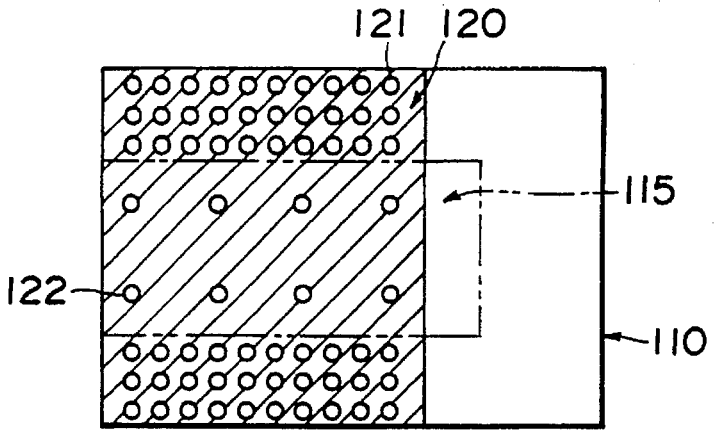
FIGS. 11A, 11B and 11C are modifications of the constitution shown in FIG. 9.

In the above-described embodiment, the through holes 117, each of which has a complete round shape, are disposed regularly (at the respective intersection point of a grid) in portions which correspond to the areas in which the first pattern 111 and the third pattern 113 are not formed. However, the present invention is not limited to this arrangement. For example, as shown in FIG. 11A, not only through holes 121 but also through holes 122 may be formed in a grounding pattern 120. The through holes 122 may be formed in a portion which corresponds to the in-resonator conductor pattern 115, in a manner similar to that used in the above-described embodiment. However, in terms of characteristics, it is desirable that the number (total area) of the through holes 122 be smaller than that of the through holes 121 as shown in FIG. 11A. According to this constitution, the adhesion between the second and third dielectric blocks 110*b* and 110*c* is improved to a further extent.

Figure 11B:
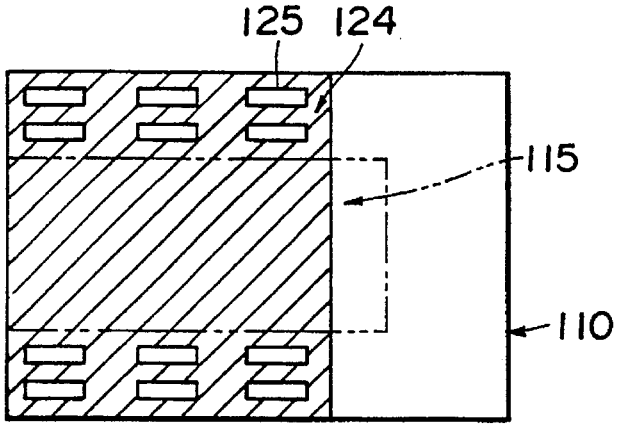
Figure 11C:
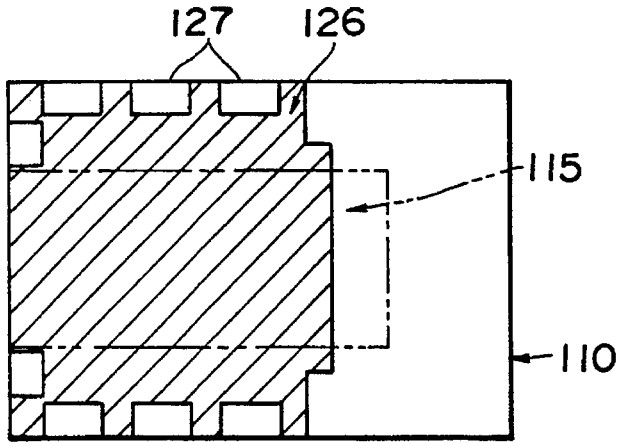
Figure 12:
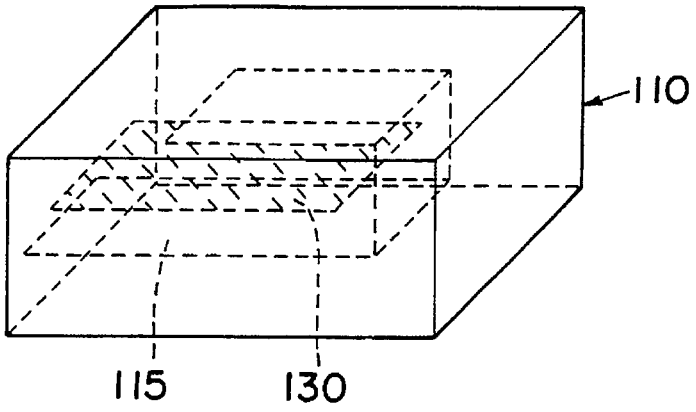
FIG. 12 is a perspective view showing a dielectric filter according to another embodiment.

As shown in FIG. 11B, through holes 125 having a rectangular shape or other arbitrary shapes may be formed in a grounding pattern 124. In addition, not only are the through holes 125 formed in the grounding pattern, but cutouts 127 may also be formed in the periphery of a grounding pattern 126 as shown in FIG. 11C. In practice, these shown constitutions may also be combined as required.

FIG. 12, 13A, 13B, 13C, 14A, 14B and 14C show other embodiments distinct from the embodiments shown in FIGS. 7 to 11C. Unlike any of the embodiments shown in FIGS. 7 to 11C, in the embodiments shown in FIGS. 12 to 14C, a grounding pattern 130 (indicated in FIGS. 12 and 14A), which is formed at a predetermined position in the dielectric block body 110, is formed by a plurality of (in the shown embodiments, two) combined auxiliary grounding patterns. In these embodiments, the grounding pattern 130 is connected at only one side to one side of the dielectric block body 110, and both longitudinal sides of the grounding pattern 130 are respectively spaced a predetermined distance apart from the corresponding sides of the dielectric block body 110.

Figure 13A:
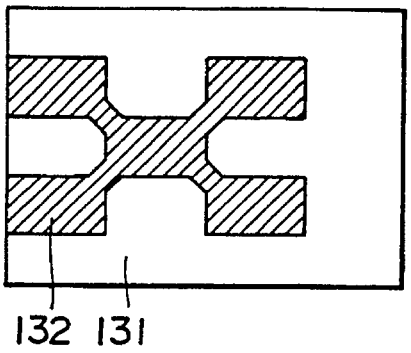
FIGS. 13A, 13B and 13C as well as 14A, 14B and 14C are explanatory views showing the essential portion (grounding pattern) of the constitution shown in FIG. 12.
Figure 13B:
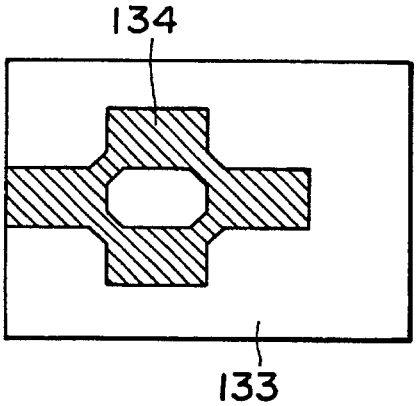

As shown in FIGS. 13A to 13C and 14A to 14C, the grounding pattern is made up of a first auxiliary grounding pattern 132 formed on the top face of a first dielectric sheet 131 and a second auxiliary grounding pattern 134 formed at a predetermined position on the top face of a second dielectric sheet 133. Specifically, as shown in FIG. 13A, the first auxiliary grounding pattern 132 is formed in the shape of an approximately staggered grid having a rectangular shape with four sides whose central portions are respectively removed to form quadrangles (each having chamfered corners). The second auxiliary grounding pattern 134 is formed in the shape of an approximately staggered grid having a rectangular shape whose four corner portions and central quadrangular portion are removed (with corners being chamfered). The first auxiliary grounding pattern 132 and the second auxiliary grounding pattern 134 are arranged in such a manner that the pattern-bearing portion of the first auxiliary grounding pattern 132 is opposed to the removed portions of the second auxiliary grounding pattern 134, while the pattern-bearing portion of the second auxiliary grounding pattern 134 is opposed to the removed portions of the first auxiliary grounding pattern 132.

Figure 13C:
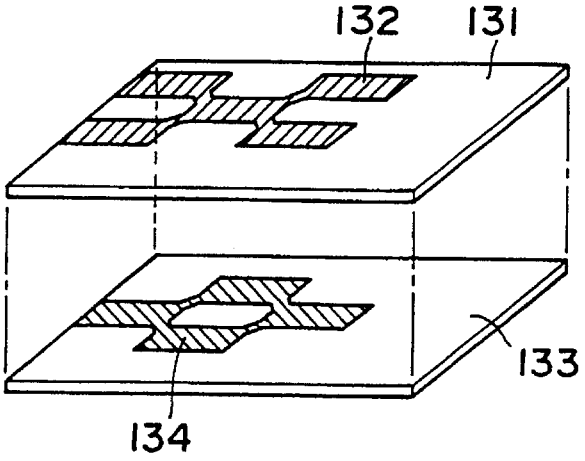
Figure 14A:
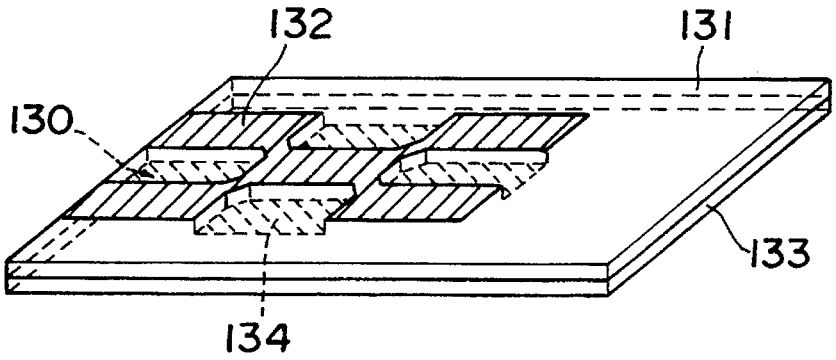
FIG. 14C is a cross-sectional view taken along line C—C of FIG. 14B.
Figure 14B:
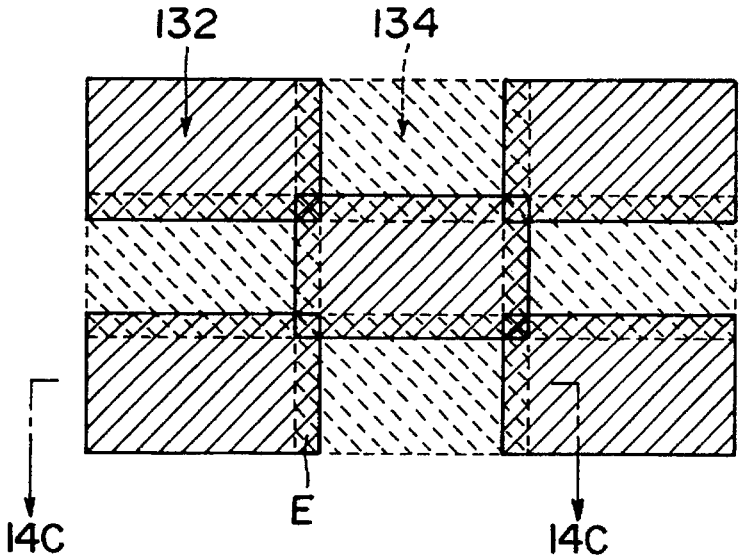

The first and second dielectric sheets 131 and 133 having the above-described constitutions are positioned as shown in FIG. 13C and are then superposed on each other as shown in FIG. 14A. As shown in FIG. 14B, their projected plan shapes constitute, as a whole, one rectangular grounding pattern in which the first and second auxiliary grounding patterns 132 and 134 are superposed in part (in an area E) on each other. The first and second auxiliary grounding patterns 132 and 134 are connected to the grounding layer 118 formed on the periphery of the dielectric block body 110, and are electrically placed at the same potential (grounded).

Accordingly, the first and second auxiliary grounding patterns 132 and 134 serve as the grounding pattern 130 for providing predetermined electrical characteristics similar to the prior art with respect to the in-resonator conductor. In addition, at the surfaces of contact between the second dielectric sheet 133 and the first dielectric sheet 131, since the first dielectric sheet (ceramics) 131 is in direct contact with the second auxiliary grounding pattern 134 excluding the pattern-bearing portion of the second auxiliary grounding pattern 134, the area of contact increases by the area of the above-described removed portions and the adhesion strength increases. A similar effect can be obtained between the first dielectric sheet 131 having the first auxiliary grounding pattern 132 and another dielectric sheet (not shown) positioned above the first dielectric sheet 131. In the shown embodiment, the combination of the two auxiliary grounding patterns 132 and 134 functions as the grounding pattern 130, so that even if the area of the removed portions per sheet is increased, the characteristics are not degraded. Specifically, although 40% was removed from each of the patterns, no practical problem was posed.

Figure 14C:
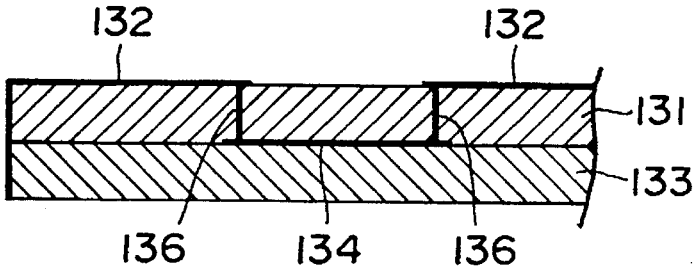

Further, in this embodiment, as shown in FIG. 14C, a through hole 136 is formed at a predetermined position in the first dielectric sheet 131, and the first auxiliary grounding pattern 132 and the second auxiliary grounding pattern 134 are electrically connected to each other. Thus, the electrical integration (the same potential) of both sheets is improved to a further extent. However, in the present invention, although the first and second auxiliary grounding patterns 132 and 134 are electrically connected by the grounding layer 118 formed on the side faces of the dielectric block body 110 (refer to FIG. 7, 8 and 10) as described above, the through hole 136 may be omitted.

In the above-described embodiment, although the two auxiliary grounding patterns 132 and 134 are respectively formed on the dielectric sheets 131 and 133 which are laminated adjacent to each other, such auxiliary grounding patterns may be formed, for example, on the opposite sides of one dielectric sheet while being positioned. Otherwise, a dielectric sheet having no auxiliary grounding pattern may be interposed between dielectric sheets on which auxiliary grounding patterns are respectively formed. However, in order to electrically integrate the auxiliary grounding patterns into one grounding pattern capable of performing a predetermined function, it is desirable to reduce the distance between both auxiliary grounding patterns as greatly as possible, as in the case of the present embodiment.

Figure 7:
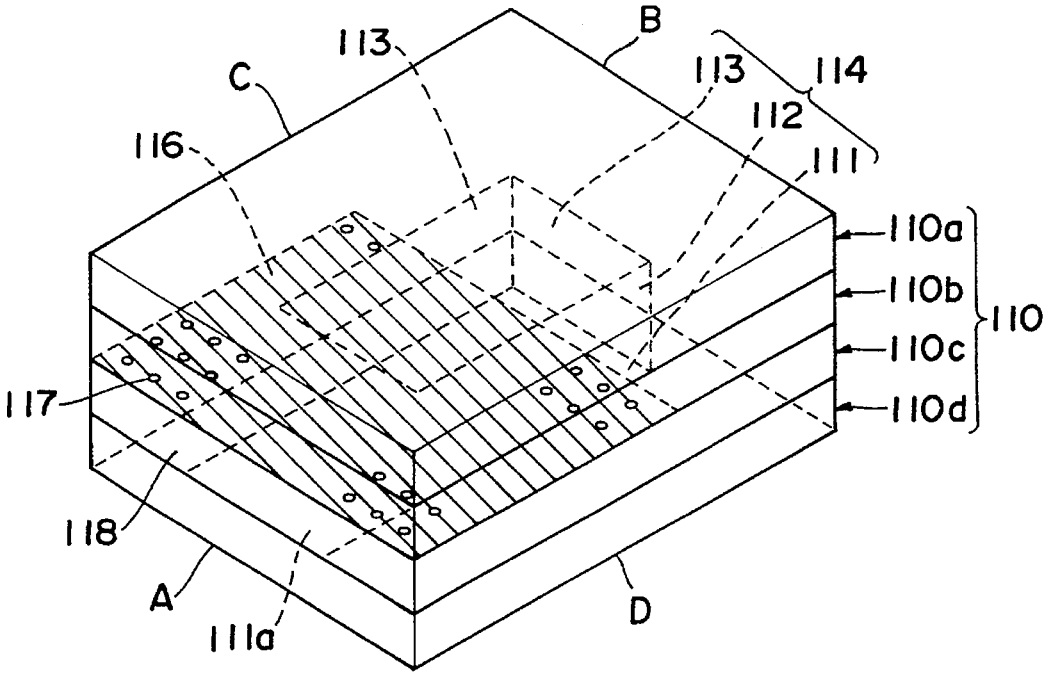
FIG. 7 is a perspective view showing the constitution of a dielectric filter for achieving the second object of the present invention.

Although not shown, in this embodiment as well, similarly to the embodiments shown in FIGS. 7 to 10, the grounding pattern 130 (the first and second auxiliary grounding patterns 132 and 134) may be extended on its longitudinal sides in opposite directions so that three sides of a rectangle which forms the grounding pattern 130 can be connected to the grounding layer 118 so as to permit electrical conduction between the grounding pattern 130 and the grounding layer 118 formed on the opposite sides of the dielectric block body (sides indicated by reference characters C and D in FIG. 7). Incidentally, the constitution, operation and effect of the other elements are similar to those of any of the embodiments or the modifications shown In FIGS. 7 to 10, detailed description is omitted.

As described above, in any of the filters according to the present invention shown in FIGS. 7 to 14C, since the through holes, the cutouts or the removed portions are provided in the grounding pattern, it is possible to increase the area of direct contact between the dielectric ceramics which constitute the dielectric blocks positioned above and below the grounding pattern, owing to the through holes or the like. Accordingly, the adhesion strength between both dielectric ceramics is increased. In consequence, it is possible to minimize the occurrence of peeling from or cracking of the grounding pattern portion during a later sintering process, whereby the yield can be improved. If a portion in which to form such through holes or the like is provided in an unsuperposed portion which is not to be superposed on the in-resonator conductor, a grounding face is formed over the entire face of a portion to be superposed on the in-resonator conductor. Accordingly, variations in characteristic impedance can be suppressed as much as possible, whereby far better filter characteristics can be obtained.

If one grounding pattern is formed by superposing a plurality of grounding patterns from which predetermined portions are removed, a predetermined shape having no holes such as through holes is formed as a whole, so that the effect (the desired electrical characteristics) of providing the grounding pattern is clearly shown. In addition, the portion of direct contact between ceramics positioned on opposite sides of one auxiliary grounding pattern is increased by the area of the removed portions. Accordingly, similarly to the above-described filters, no cracking or the like occurs during a sintering process. Also, if the auxiliary grounding patterns are connected to each other via the conductive through hole, the electrical integration (the same potential) of the auxiliary grounding patterns is promoted and the characteristics are improved to a further extent.

We claim:

1. A laminated dielectric resonator comprising:

a block-shaped dielectric material made up of a plurality of sheets laminated;

an in-resonator conductor formed in said block-shaped dielectric material;

said in-resonator conductor including a short-circuit-side internal conductor pattern and an open-end-side internal conductor pattern which are opposed to each other in spaced apart relationship in a pattern-thickness direction, as well as a via connection part which connects one end of said short-circuit-side internal conductor pattern to one end of said open-end-side internal conductor pattern;

an external grounding conductor formed on an external surface of said dielectric material in such a manner as to be connected to the other end of said short-circuit-side internal conductor pattern but not to the other end of said open-end-side internal conductor pattern; and an internal grounding conductor provided between said internal conductor patterns formed in said dielectric material, said internal grounding conductor being connected to said external grounding conductor but not to said via connection part, thereby forming a folded microstrip line type resonator structure, wherein the distance between said internal grounding conductor and said external grounding conductor between which said open-end-side internal conductor pattern is disposed is shorter than the distance between said internal grounding conductor and said external grounding conductor between which said short-circuit-side internal conductor pattern is disposed.

2. A laminated dielectric resonator according to claim 1, wherein the following relationship is satisfied:

$0.4<t_1/t_2<1.0$ where $t_1$ indicates said distance between said internal grounding conductor and said external grounding conductor between which said open-end-side internal conductor pattern is disposed and $t_2$ indicates said distance between said internal grounding conductor and said external grounding conductor between which said short-circuit-side internal conductor pattern is disposed.

3. A laminated dielectric resonator according to claim 1, wherein said other end of said open-end-side internal conductor pattern is exposed on a surface portion of said dielectric material, an open end face in which said external grounding conductor is absent is formed around said surface portion on which said other end of said open-end-side internal conductor pattern is exposed, and the entire surface excluding said open end face is covered with said external grounding conductor.

4. A laminated dielectric filter comprising:

a block-shaped dielectric material made up of a plurality of sheets laminated;

a plurality of in-resonator conductors formed in said block-shaped dielectric material in spaced apart relationship in a pattern-width direction;

each of said in-resonator conductors including a short-circuit-side internal conductor pattern and an open-end-side internal conductor pattern which are opposed to each other in spaced apart relationship in a pattern-thickness direction, as well as a via connection part which connects one end of said short-circuit-side internal conductor pattern to one end of said open-end-side internal conductor pattern;

an external grounding conductor formed on an external surface of said dielectric material in such a manner as to be connected to the other end of said short-circuit-side internal conductor pattern but not to the other end of said open-end-side internal conductor pattern; and an internal grounding conductor provided between said internal conductor patterns formed in said dielectric material, said internal grounding conductor being connected to said external grounding conductor but not to said via connection part, thereby forming a folded microstrip line type resonator structure, wherein the distance between said internal grounding conductor and said external grounding conductor between which said open-end-side internal conductor pattern is disposed is shorter than the distance between said internal grounding conductor and said external grounding conductor between which said short-circuit-side internal conductor pattern is disposed.

5. A laminated dielectric filter according to claim 4, wherein said plurality of in-resonator conductors constitute a comb-line structure in which said via connection parts are positioned on the same side.

6. A laminated dielectric filter according to claim 4, wherein said plurality of in-resonator conductors constitute an interdigital structure in which said via connection parts are alternately positioned on opposite sides.

7. A dielectric filter comprising:

a dielectric block body formed by a plurality of dielectric blocks disposed in lamination;

an in-resonator conductor formed in a folded state between said plurality of dielectric blocks;

a grounding pattern disposed inward of a folded portion of said folded in-resonator conductor in the state of being superposed in part over said folded in-resonator conductor, at a position spaced a predetermined distance apart from said folded portion in a thickness direction; and a communication part provided in a predetermined portion of said grounding pattern.

8. A dielectric filter according to claim 7, wherein said communication part is formed in a portion of said grounding pattern which excludes a portion superposed on said in-resonator conductor.

9. A dielectric filter according to claim 7, wherein said grounding pattern is made up of a plurality of auxiliary grounding patterns spaced a predetermined distance apart from each other in a thickness direction and disposed to be held at the same potential, each of said auxiliary grounding patterns having a removed portion formed by removing a predetermined portion, said auxiliary grounding patterns being superposed on each other in such a manner that said removed portion of either of said auxiliary grounding patterns is covered by a pattern portion of any other one.

10. A dielectric filter according to claim 9, wherein said plurality of auxiliary grounding patterns are electrically connected to each other via a conductive through hole.

11. A dielectric filter according to claim 7, wherein said communication part is made from a through hole.

12. A dielectric filter according to claim 7, wherein said communication part is made from a cutout.

* * * * *